US011987897B2

(12) United States Patent
Bergman et al.

(10) Patent No.: US 11,987,897 B2
(45) Date of Patent: May 21, 2024

(54) SYSTEMS AND METHODS FOR SHIELDING FEATURES OF A WORKPIECE DURING ELECTROCHEMICAL DEPOSITION

(71) Applicant: APPLIED Materials, Inc., Santa Clara, CA (US)

(72) Inventors: Eric J. Bergman, Kalispell, MT (US); Jeffrey J. Dennison, Columbia Falls, MT (US); Marvin L. Bernt, Kalispell, MT (US)

(73) Assignee: APPLIED Materials, Inc., Santa Clara, CA (US)

( * ) Notice: Subject to any disclaimer, the term of this patent is extended or adjusted under 35 U.S.C. 154(b) by 464 days.

(21) Appl. No.: 15/400,586

(22) Filed: Jan. 6, 2017

(65) Prior Publication Data

US 2017/0191180 A1 Jul. 6, 2017

Related U.S. Application Data

(60) Provisional application No. 62/275,674, filed on Jan. 6, 2016.

(51) Int. Cl.
*C25D 17/00* (2006.01)
*C25D 5/02* (2006.01)
(Continued)

(52) U.S. Cl.
CPC ..... *C25D 17/002* (2013.01); *C25D 5/022* (2013.01); *C25D 5/04* (2013.01); *C25D 17/008* (2013.01); *C25D 21/10* (2013.01); *C25D 17/005* (2013.01)

(58) Field of Classification Search
None
See application file for complete search history.

(56) References Cited

U.S. PATENT DOCUMENTS 5,332,487 A 7/1994 Young, Jr. et al.
6,027,631 A 2/2000 Broadbent
(Continued)

FOREIGN PATENT DOCUMENTS

CN 1329681 A 1/2002
CN 100422389 C 10/2008
(Continued)

OTHER PUBLICATIONS

International Preliminary Report on Patentability dated Jul. 19, 2018, issued in corresponding International Application No. PCT/US2016/066655, filed Dec. 14, 2016, 14 pages.
(Continued)

*Primary Examiner* — Stefanie S Wittenberg
(74) *Attorney, Agent, or Firm* — Christensen O'Connor Johnson Kindness PLLC

(57) ABSTRACT

In one embodiment, an electroplating cell for depositing a metal onto a surface of a substrate includes an electroplating chamber configured to receive an electrolyte containing metal ions and a substrate having a surface disposed to contact the electrolyte, wherein the surface of the substrate is configured to serve as a cathode and wherein the surface of the substrate includes an anomaly region at or near the outer perimeter of the surface of the substrate, an anode disposed in the electrolyte chamber, a shielding device disposed between the cathode and the anode to shield the anomaly section, an oscillator configured to impart a relative oscillation between the cathode and the shielding device, and a power source to cause an electric field between the anode and the cathode.

19 Claims, 16 Drawing Sheets

(51) Int. Cl.
*C25D 5/04* (2006.01)
*C25D 21/10* (2006.01)

(56) References Cited

U.S. PATENT DOCUMENTS

| | | | | |
|---|---|---|---|---|
| 6,402,923 | B1 * | 6/2002 | Mayer | C25D 17/12 204/224 R |
| 6,551,483 | B1 | 4/2003 | Mayer et al. | |
| 6,685,814 | B2 * | 2/2004 | Uzoh | C25D 17/001 205/640 |
| 6,773,571 | B1 | 8/2004 | Mayer et al. | |
| 2002/0119671 | A1 | 8/2002 | Lee | |
| 2004/0104119 | A1 | 6/2004 | Edelstein et al. | |
| 2004/0129384 | A1 | 7/2004 | Tomari | |
| 2004/0182715 | A1 * | 9/2004 | Bogart | C25D 17/001 205/133 |
| 2004/0262150 | A1 * | 12/2004 | Yajima | C25D 7/123 204/224 R |
| 2007/0151844 | A1 * | 7/2007 | Wilson | C25D 5/18 204/230.2 |
| 2010/0044236 | A1 * | 2/2010 | Mayer | C25D 17/008 205/80 |
| 2012/0043654 | A1 * | 2/2012 | Lu | H01L 21/76877 257/737 |
| 2012/0258408 | A1 * | 10/2012 | Mayer | H01L 21/2885 430/325 |
| 2012/0292195 | A1 * | 11/2012 | Lee | C25D 17/008 205/133 |
| 2013/0137242 | A1 * | 5/2013 | He | C25D 21/12 438/468 |
| 2013/0248361 | A1 | 9/2013 | Sto. Domingo | |
| 2015/0060291 | A1 | 3/2015 | Mayer et al. | |
| 2016/0068988 | A1 * | 3/2016 | Uzoh | F02C 7/042 204/222 |
| 2016/0333495 | A1 * | 11/2016 | Kagajwala | H01L 21/2885 |

FOREIGN PATENT DOCUMENTS

| | | | | |
|---|---|---|---|---|
| CN | 101555610 | A | 10/2009 | |
| CN | 101736376 | A | 6/2010 | |
| CN | 101847598 | A | 9/2010 | |
| CN | 102732924 | A | 10/2012 | |
| CN | 102762778 | A | 10/2012 | |
| CN | 103572342 | A | 2/2014 | |
| CN | 103732804 | A | 4/2014 | |
| CN | 103911639 | A | 7/2014 | |
| CN | 103993345 | A | 8/2014 | |
| CN | 207109104 | U | 3/2018 | |
| JP | 2005089812 | * | 4/2005 | C25D 17/10 |
| JP | 2006086513 | A | 3/2006 | |
| TW | 200732507 | A | 9/2007 | |
| WO | 99/26275 | A2 | 5/1999 | |

OTHER PUBLICATIONS

International Search Report and Written Opinion dated Apr. 6, 2017, issued in corresponding International Application No. PCT/US2016/066655, filed Dec. 14, 2016, 16 pages.

First Office Action dated Dec. 24, 2019, received Jan. 15, 2020, issued in corresponding Chinese Application No. 201710010758.7, filed Jan. 6, 2017, 11 pages.

Examination Notice and Search Report dated Jul. 30, 2020, issued in corresponding Taiwanese Application No. 105141538, filed Jan. 6, 2017, 16 pages.

Notice of Allowance dated Mar. 30, 2021, issued in corresponding Chinese Application No. 201710010758.7, filed Jan. 6, 2017, 6 pages.

Office Action dated May 30, 2023, issued in corresponding Korean Patent Application No. 10-2018-7022454, filed Dec. 14, 2016, with English summary, 14 pages.

Office Action dated Jan. 9, 2024, issued in corresponding Korean Patent Application No. 10-2018-7022454, filed Dec. 14, 2016, with English summary, 10 pages.

* cited by examiner

SYSTEMS AND METHODS FOR SHIELDING FEATURES OF A WORKPIECE DURING ELECTROCHEMICAL DEPOSITION

CROSS-REFERENCE TO RELATED APPLICATION

This application claims the benefit of U.S. Provisional Application No. 62/275674, filed Jan. 6, 2016, the disclosure of which is hereby expressly incorporated by reference herein in its entirety.

BACKGROUND

A challenge in electrochemical deposition on workpieces includes the shielding of anomaly regions on the workpiece, for example, test-dies or test features on the workpiece or masked areas on the workpiece, such as the workpiece scribe region. Therefore, improved techniques are needed for process variations in electrochemical deposition on workpieces.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, an electroplating cell for depositing a metal onto a surface of a substrate is provided. The electroplating cell includes an electroplating chamber configured to receive an electrolyte containing metal ions and a substrate having a surface disposed to contact the electrolyte, wherein the surface of the substrate is configured to serve as a cathode and wherein the surface of the substrate includes an anomaly region at or near the outer perimeter of the surface of the substrate. The electroplating cell further includes an anode disposed in the electrolyte chamber, a shielding device disposed between the cathode and the anode to shield the anomaly section, an oscillator configured to impart a relative oscillation between the cathode and the shielding device, and a power source to cause an electric field between the anode and the cathode.

In accordance with another embodiment of the present disclosure, a method of electroplating a metal onto a surface of a substrate in an electroplating chamber configured to receive an electrolyte containing metal ions, an anode, and a substrate having a surface disposed to contact the electrolyte, wherein the surface of the substrate is configured to serve as a cathode, and wherein the surface of the substrate includes an anomaly region at or near the outer perimeter of the surface of the substrate is provided. The method includes providing a shielding device in an electrolyte chamber wherein the shielding device is configured to shield the anomaly region, imparting an electric field between the anode and the cathode, and imparting a relative oscillation between the cathode and the shielding device.

In accordance with another embodiment of the present disclosure, a device for shielding a surface of a substrate in an electroplating chamber for electroplating a metal on to the surface of the substrate, the electroplating chamber configured to receive an electrolyte containing metal ions, an anode, and a substrate having a surface disposed to contact the electrolyte, wherein the surface of the substrate is configured to serve as a cathode, and wherein the surface of the substrate includes an anomaly region at or near the outer perimeter of the surface of the substrate is provided. The device includes an outer perimeter configured for alignment with the outer perimeter of the substrate, and an extension section extending inwardly from the outer perimeter in the range of about 5 mm to about 25 mm of the radial distance of the outer ring.

In any of the embodiments described herein, the shielding device may be shaped to have an outer ring and an extension section extending inwardly from the outer ring.

In any of the embodiments described herein, the extension section may extend inwardly from the outer ring in the range of about 5 mm to about 25 mm of the radial distance of the outer ring.

In any of the embodiments described herein, the extension section may have an angular length in the range of about 2 degrees to about 35 degrees.

In any of the embodiments described herein, the extension section of the shielding device may be shaped and sized to substantially align with the shape of the anomaly region.

In any of the embodiments described herein, the oscillator may be configured to oscillate the cathode, and wherein the shielding device is a fixed shielding device.

In any of the embodiments described herein, the electroplating cell may further include a mixing device for mixing the electrolyte.

In any of the embodiments described herein, the shielding device may be located between the mixing device and the substrate.

In any of the embodiments described herein, the shielding device may be located between the mixing device and the anode.

In any of the embodiments described herein, the shielding device may be integrated into the mixing device.

In any of the embodiments described herein, the oscillator may be configured to oscillate the cathode, and wherein the shielding device moves with the mixing device.

In any of the embodiments described herein, the oscillator may be configured to oscillate the mixing device.

In any of the embodiments described herein, imparting a relative oscillation between the surface and the shielding device may include oscillating the cathode relative to a fixed shielding device.

In any of the embodiments described herein, imparting a relative oscillation between the surface and the shielding device may include running a plurality of oscillation periods.

In any of the embodiments described herein, a method of operation may further include rotating the cathode for at least a portion of the time between sequential oscillation periods.

In any of the embodiments described herein, a method may further include mixing the electrolyte with a mixing device.

In any of the embodiments described herein, the shielding device may be integrated into the mixing device.

In any of the embodiments described herein, imparting a relative oscillation between the surface and the shielding device may include oscillating the mixing device relative to a rotating cathode.

In any of the embodiments described herein, a shielding device may further including mixing fins and channels.

DESCRIPTION OF THE DRAWINGS

The foregoing aspects and many of the attendant advantages of this disclosure will become more readily appreciated as the same become better understood by reference to the following detailed description, when taken in conjunction with the accompanying drawings, wherein.

DETAILED DESCRIPTION

Figure 1:
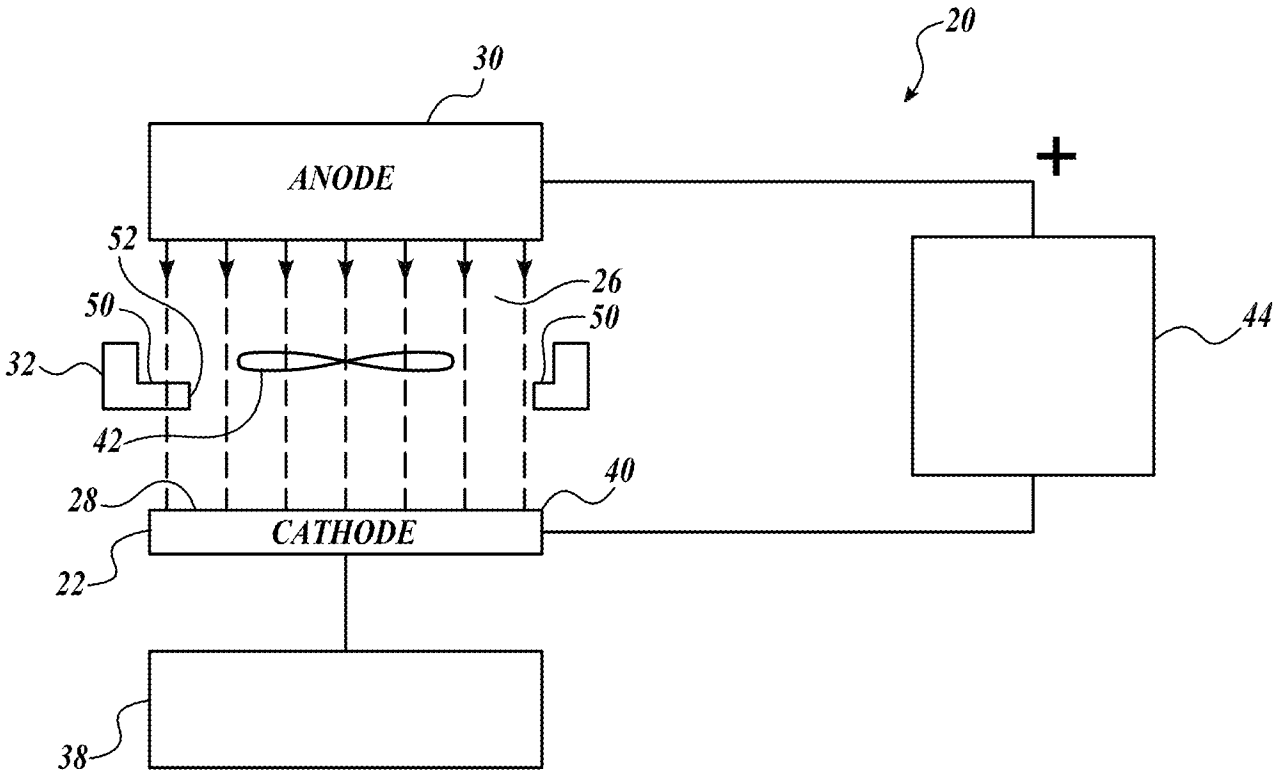
FIG. 1 is a schematic of an electroplating cell in accordance with one embodiment of the present disclosure including a shielding device in cross-section.
Figure 2:
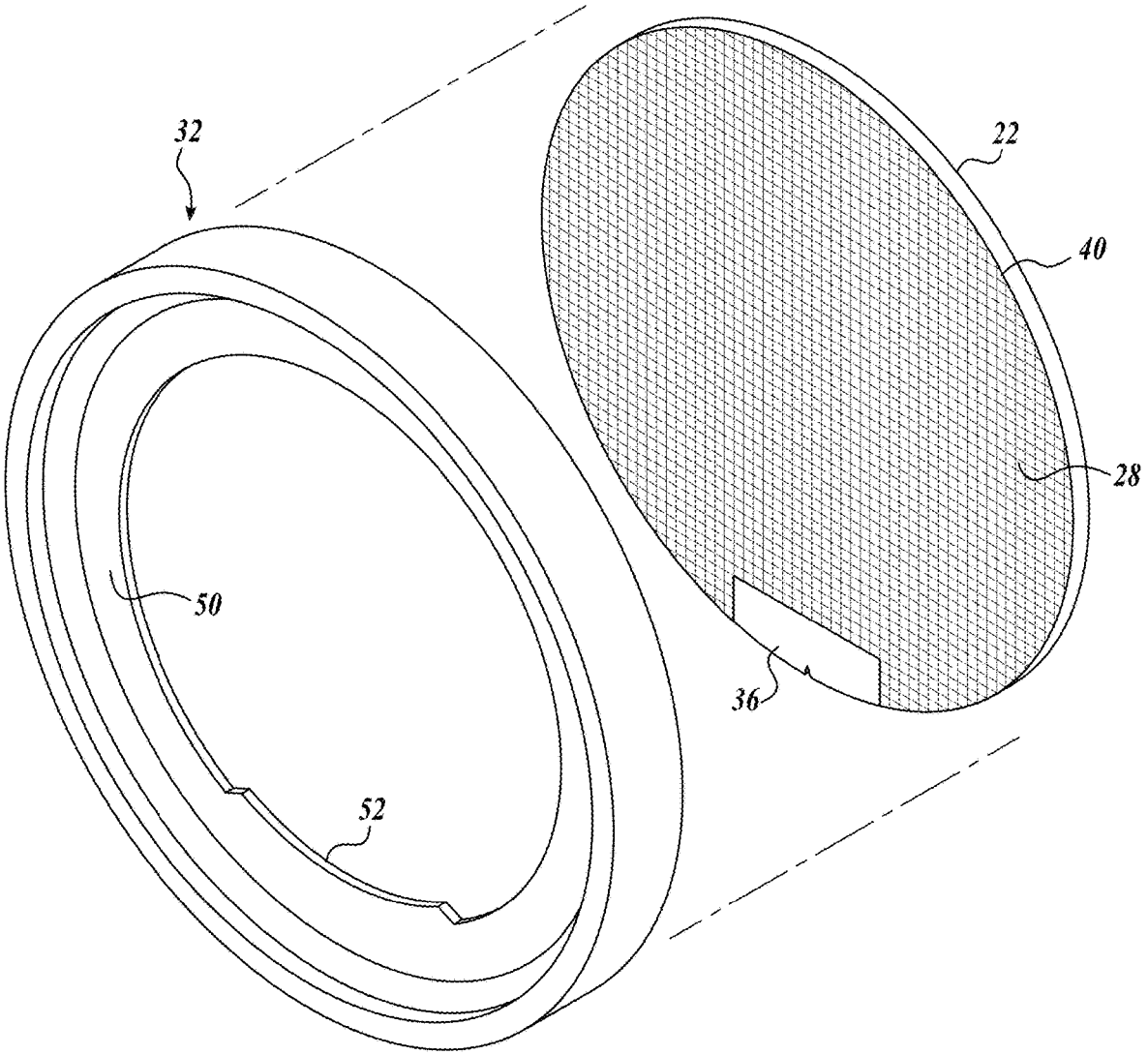
FIG. 2 is a perspective view of a shielding device in accordance with one embodiment of the present disclosure next to an exemplary workpiece having a masked scribe area.

Embodiments of the present disclosure are directed to electroplating cells including shielding devices and methods of shielding portions of a workpiece during electrochemical deposition processes. Referring to FIGS. 1 and 2, one embodiment of the present disclosure is provided, including an electroplating cell 20 including a shielding device 32 to reduce non-uniformities in plating thickness on particular areas of a workpiece 22, for example, near an anomaly regions, such as a masked scribe region 36 of the workpiece 22.

In the field of electrochemical deposition for the manufacture of microelectronic devices, such as computer chips, conductive metallic films are deposited on devices formed on substrates. Substrates may include silicon, glass, silicon on sapphire, gallium arsenide, etc.

Referring to FIG. 1, an electroplating cell 20 includes an electrolyte chamber 24 configured to receive an electrolyte 26 containing metal ions and a substrate or workpiece 22 having a surface 28 disposed to contact the electrolyte 26, wherein the surface 28 of the workpiece 22 is configured to serve as a cathode. The electroplating cell 20 further includes an anode 30 disposed in the electrolyte chamber 24, and a power source 44 to cause an electric field between the anode 30 and the cathode 28.

Referring to FIGS. 1 and 2, one embodiment of the present disclosure is provided, including a shielding device 32 to reduce non-uniformities in plating thickness on particular areas of a workpiece 22, for example, near a masked scribe region 36 of the workpiece 22. The electroplating cell 20 further includes an oscillator 38 configured to impart a relative oscillation between the surface 28 of the workpiece 22 and the shielding device 32. Also, the electroplating cell 20 includes a paddle 42 for mixing the electrolyte and to assist in mass transfer of metal ions to the workpiece 22.

Workpieces may be designed with geometry specific anomalies located at the workpiece edges. For example, a workpiece may include a feature, such as a notch, at the workpiece edge along the perimeter to orient the workpiece during electrochemical deposition.

As seen in FIG. 2, a workpiece 22 may include a scribe region 36 at the workpiece edge 40 along the outer perimeter, which may include workpiece identification information. A workpiece scribe region 36 is typically located in a region that has not been patterned for electrochemical deposition. Instead, the scribe region 36 is masked to prevent plating in the region. The lack of patterning in the scribe region 36 can be problematic in electrochemical deposition processes because of the resultant change in current distribution in the seed layer of the workpiece.

During the plating process with reference to FIG. 1, the workpiece 22 is immersed in an electrolyte 26 with current flowing from an anode 30 through the electrolyte 26 to the workpiece 22 acting as the cathode. The plating process results in deposition of a conductive film on the exposed surface 28 of the workpiece 22 in as uniform a layer as practically possible. However, changes in pattern density of a conductive film can affect the current distribution in the conductive layer.

The open area for plating in electrochemical deposition processes includes the areas with no photoresist mask where metal can be plated on an available seed layer. In workpiece-specific electroplating processes, the open area may be in the range from as little as about 5% to as much as about 80%. Locally, regions with a high percentage of open area for plating will result in a lower current distribution and a lower plating rate. Regions with a low percentage of open area will result in a higher current distribution and a higher plating rate. As described in EXAMPLE 6 (FIG. 7) below, an increased percentage of open area on a workpiece can increase non-uniformity in plating across the workpiece.

Microelectronic devices are typically small and include repeating patterns. Therefore, current distribution generally does not vary significantly across the workpiece. Although variations within a single die may be present, the focus of the present disclosure is on workpiece edge variations and anomalies, such as the scribe region.

A consistent challenge in plating workpieces occurs at the edge of the workpiece, where the patterning ends. Typically, there is an "edge exclusion" region around the workpiece perimeter, extending about 1 mm to about 3 mm into the workpiece. The edge exclusion region has an exposed seed layer to conduct the current from the workpiece contacts located at the workpiece edge. The electrical contacts in the electroplating cell to the seed layer may be protected by a seal such that plating will only occur in the patterned region of the workpiece and not on the electrical contacts.

The region under the seal forms part of the conductive path and is adjacent a patterned region. Therefore, the excess current not used to plate in the masked region will preferentially migrate to the nearest open region. In the nearest open region, the excess current tends to accelerate the plating. Therefore, an increase in plating thickness can be seen on the edge of the workpiece.

Plating on the workpiece perimeter can be largely controlled by the use of shielding devices. Typical shielding devices are annular rings of a non-conductive material placed in the plating chamber between the workpiece and the anode to selectively block the electric field on the workpiece perimeter. The selective blocking of the workpiece edge can help to improve the uniformity of the electrodeposit.

However, when there is an anomaly or a significant disruption in the pattern density or repetitive frequency of the pattern to be plated, a problem arises. This anomaly or disruption may occur as a result of the presence of, for example, a test-die or test features located on the workpiece. These test features may have different patterns from the active devices. Therefore, the active devices surrounding the test die may experience a shift in the pattern density resulting in a change in the electrochemical deposition rate. Other common anomalies that may disrupt the current density on the workpiece include masked areas on the workpiece, for example, the workpiece scribe region 36 (see FIG. 2).

The workpiece 22 is typically rotated during the electrochemical deposition process. As a non-limiting example, in one process, the workpiece may be rotated clockwise (CW) at 3 rpm for 47 seconds, then counter-clockwise (CCW) at 3 rpm for 47 seconds for a predetermined total amount of time depending on the plating thickness to be achieved. Rotation can typically be in the range of about 1 to about 300 RPM. Because there is a paddle 42 in the electroplating cell 20, rotation of the workpiece 22 is not necessary for electrolyte 26 mixing and mass transfer of metal ions to the plating surface 28 of the workpiece 22.

When shielding a specific region on the edge of the workpiece 22, there is a need for means to shield the specific region (for example, the scribe region 36) more than the other regions on the workpiece edge 40. One means of shielding includes a fixed shielding device extending inwardly from the edge of the workpiece to a distance sufficient to shield the desired feature. This type of fixed shield will be of specific dimensions corresponding to the region on the workpiece. If the workpiece is rotated over top of the shielding device at a constant velocity, then every location on the workpiece edge will be shielded to the same degree. However, if the velocity of the workpiece is changed, for example, the velocity is reduced as a specific region of the workpiece is crossing the shielding feature, then this specific region will be proportionally shielded more than adjacent regions which cross the shielding device at a higher velocity. As a result, the specific region will be exposed to less of the electric field and therefore will experience a reduction in the plating rate. This reduction in the plating rate can be used to offset the increase in plating rate which regions adjacent to a non-patterned area, such as a notch or masked region around a scribe, might otherwise see.

A potential problem with changing the velocity of the workpiece is the velocity has usually been selected for a specific reason, such as to promote uniformity of the bulk transport or to improve mass transfer across the workpiece or some portion thereof. Therefore, changing the velocity of the workpiece may not always be desirable.

In accordance with one embodiment of the present disclosure, relative rotational oscillation is used to achieve a region-specific shielding on the workpiece. Referring to FIG. 1, the shielding device 32 in accordance with one embodiment of the present disclosure is disposed between the cathode and the anode and is designed and configured to shield an anomaly on the workpiece, such as a masked scribe region 36 of the workpiece 22.

In the illustrated embodiment, the shielding device 32 is shaped to have an outer ring 50 to shield the edge 40 of the workpiece 22. The shielding device 32 further includes and an inward extension section 52 extending inwardly from the outer ring 50 in the range of about 5 mm to about 25 mm of the radial distance of the shielding device 32 and having an angular length in the range of about 2 degrees to about 35 degrees.

The length and shape of the inward extension section 52 may vary depending on the dimensions of the anomaly area to be shielded. Moreover, because oscillation is used, a standard inward extension section 52 can be used to shield various anomaly areas having different shapes and sizes.

The shielding device 32 is made from a non-conductive material, such as polypropylene, PPO, polyethylene, or any other non-conductive material.

In one embodiment of the present disclosure, the shielding device 32 is configured to oscillate in the electroplating cell 20. As mentioned above, the electroplating cell 20 includes an oscillator 38 configured to impart a relative oscillation between the surface 28 of the workpiece 22 and the shielding device 32. In one embodiment of the present disclosure, the oscillator 38 is used to oscillate the shielding device 32 relative to the workpiece 22 by using a separate oscillation motor from the workpiece rotation motor. The oscillator 38 will oscillate the shielding device 32 around a center axis of the shielding device 32.

In another embodiment of the present disclosure, the oscillator 38 is used to oscillate the workpiece 22 relative to the shielding device 32 when the workpiece 22 is not being rotated. In one non-limiting example, the motor used to rotate the workpiece 22 can also be used to oscillate the workpiece 22 around the center axis of the workpiece 22. While it is common to rotate a substrate during electrochemical deposition, it is also common to change the direction of rotation on a frequent interval to promote plating uniformity and the uniformity of the plated features. Modern spin motors are very precise. If the workpiece is loaded into the plating chamber with a known orientation, the edge anomalies such as the scribe region 36 will be known as covering a specific angle and arc of the workpiece 22 perimeter. Knowing this, the process controller can be programmed to reverse direction or oscillate in a manner such that the region 36 of the anomaly and areas surrounding it will be aligned with the inward extension section 52 of the shielding device 32 for a greater proportion of the time than the rest of the workpiece edge 40, resulting in more shielding over this region to offset the increased plating rate which would otherwise occur because of the change or lack of patterning in this area.

In an exemplary embodiment of the present disclosure, electroplating may occur in multiple process steps. For example, the electroplating process will include one or more oscillation sequences, wherein the workpiece is rotated for less than one 360 degree revolution before the direction of rotation is changed. Electroplating will further include one or more rotation sequences, wherein the workpiece is rotated for more than 360 degrees before the direction of rotation is changed.

The process may start with either workpiece rotation or workpiece oscillation, and both rotation and oscillation sequences may be present in the recipe. As a result of oscillation, the scribe region 36 will spend more time over the shielding extension section 52 during oscillation sequences than during rotational sequences. The non-scribe regions of the workpiece 22 and the scribe region 36 of the workpiece 22 will spend approximately the same amount of time over the shielding extension section 52 during rotational sequences, providing non-preferential shielding of the scribe region 36 during rotation.

As a non-limiting example, assuming a workpiece with a 30% open area and a desire to plate 40 microns of copper in approximately 15 minutes, the current may be approximately 25 amps for 15 minutes in a copper plating bath. For ease of explanation in this example, we will use two plating sequences. First, the workpiece runs 7.5 minutes in the oscillation mode where the scribe is located such that the right edge of the scribe is aligned over the left edge of the shielding feature and the workpiece is rotated for 4 seconds at 1 RPM in the direction to bring the scribe to pass over top of the shielding feature before reversing direction for 4 seconds at 1 RPM. A fixed point on the workpiece edge will travel a distance of approximately 24 degrees or 62 mm linear distance at the edge of the workpiece before reversing direction. Assuming the scribe region of the workpiece is 20 mm in length and the shielding extension section is 40 mm in length, some portion of the scribe region will be over top of the shielding feature approximately 97% of the time.

Second, the workpiece runs 7.5 minutes in the rotation mode. During rotation, the system is programmed to rotate at 5 RPM for 47 seconds before reversing direction. The edge of the workpiece will travel 3691 mm between direction reversals, and some portion of the scribe will be over top of the shielding feature less than 17% of the time and this time will be identical for every 20 mm portion of the workpiece edge. Therefore, there is no preferential shielding for any given locale on the workpiece edge during rotation.

By changing the ratio of the time spent in oscillation to rotation, the system can be designed to provide more or less shielding of the scribe region, as desired. Couple this with changes to rotational speed and time between direction reversals, and the shielding of the scribe region can be optimized to achieve a minimal difference in plating character when comparing the scribe region to the non-scribe regions of the workpiece. Therefore, the impact from the pattern differences can be modulated by increasing the effective shielding around the scribe to offset the effect of the scribe.

The oscillator "oscillates" by imparting rotational movement to either the shielding device 32 or the workpiece 22 over a partial revolution. Therefore, oscillation reverses direction of movement before rotating a full 360 degree rotation. For example, in accordance with one non-limiting example, a shielding oscillation pattern includes 1 rpm for 4 seconds both CW and CCW. Therefore, in this example, the angular movement of oscillation is about 24 degrees or 1/15 of the angular distance of the workpiece. The oscillation time depends on size of the scribe and can range from approximately 10% to approximately 75% of total plating time.

As a non-limiting example, if total plating time is 8 minutes or 480 seconds and the program is to oscillate over the scribe region for 50% of the plating time, the recipe might include, for example, two ECD steps. The first step (ECD 1) would be 240 seconds or 4 minutes in length. Oscillation occurs during this step, with the scribe region located over the shielding feature and the workpiece rotating at 1 RPM. Direction is reversed every 4 seconds. Therefore, total travel is approximately 24 degrees in one direction before reversing, with total travel being approximately 62 mm. The second step (ECD 2) will be 240 seconds or 4 minutes using 3 RPM for 47 seconds before reversing. Therefore, the workpiece travels more than one complete revolution before reversal rather than oscillating a localized portion of the workpiece over the shielding feature.

Other oscillation patterns may be imparted depending on the size and shape of the anomaly on the workpiece and/or the size and shape of the inward extension section 52 on the shielding device 32 and how the two align with each other. For example, an anomaly that is larger in angular length than the angular length of the inward extension section 52 may still be effectively shielded by a shielding device 32 that is oscillated over a larger angular range for partial rotation. Likewise, an anomaly that is smaller in angular length than the angular length of the inward extension section 52 may not require the same angular range for partial rotation.

The advantageous effect of embodiments of the present disclosure is relative oscillation between the surface 28 of the workpiece 22 and the shielding device 32 over the masked scribe region 36 reduces non-uniformity in plating thickness near the masked scribe region 36. See results in EXAMPLES 2-5 below. Moreover, another advantageous effect is relative oscillation between the surface 28 of the workpiece 22 and the shielding device 32 over the masked scribe region 36 (as opposed to a fixed shield) causes a feathering effect to distribute the current. The feathering effect tends to reduce the extremes of the peaks and valleys in plating near the masked scribe region 36.

In previously designed shielding devices, the shielding device was attached to the workpiece. Therefore, there was no opportunity for oscillation changes of the shielding device relative to the workpiece and the shielding was limited to the shape of the shielding device. Moreover, the advantage of feathering to distribute the current as a result of relative oscillation between the surface of the workpiece and the shielding device was not present.

In another previously developed system, as described in U.S. Pat. No. 6,027,631, issued on Feb. 22, 2000, the system does not include a paddle for electrolyte mixing and therefore depends on rotation of the workpiece for mass transfer. In this system, the shield rotates in an angular rate or direction different from the rotation of the cathode. The shield does not oscillate.

In another embodiment of the present disclosure, the shielding device 32 may be positioned in the electroplating cell on the anode 30 side of the paddle 42. The inventors have found that the positioning of the shielding device 32 on the cathode 28 side of the paddle 42 or on the anode 30 side of the paddle 42 provides suitable shielding of the scribe region 36 on the workpiece 22.

Referring to FIGS. 8-13, another embodiment of a shielding device 132 in accordance with the present disclosure is provided. The shielding device 132 of FIGS. 8-13 is similar to the shielding device 32 of FIGS. 1 and 2, except the shielding device 132 incorporates both shielding and electrolyte mixing capabilities. References numerals for the embodiment of FIGS. 8-13 are similar to the reference numerals of FIGS. 1 and 2, except in the 100 series.

Figure 8:
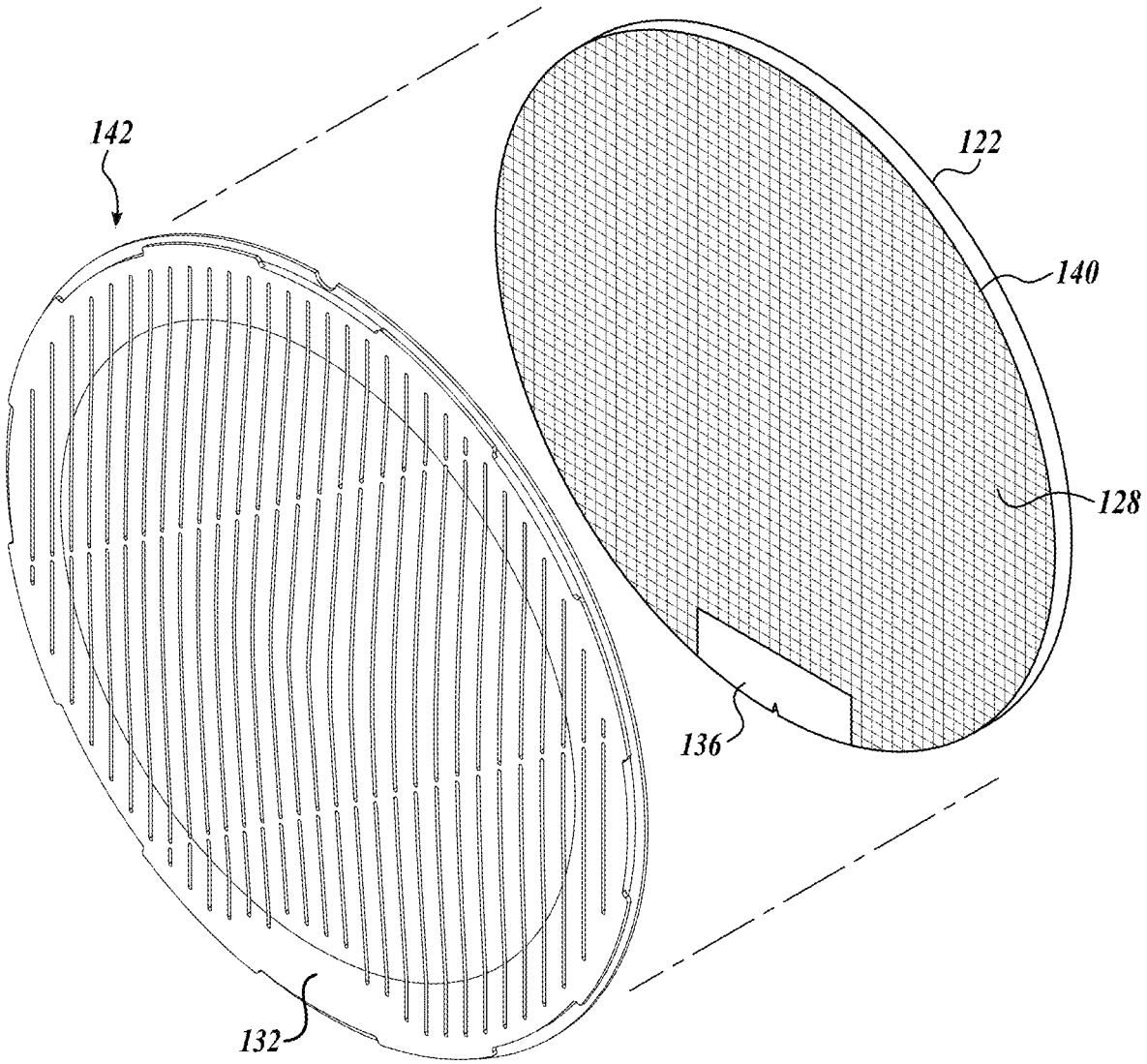
FIG. 8 is a schematic of an electroplating cell in accordance with another embodiment of the present disclosure.
Figure 9:
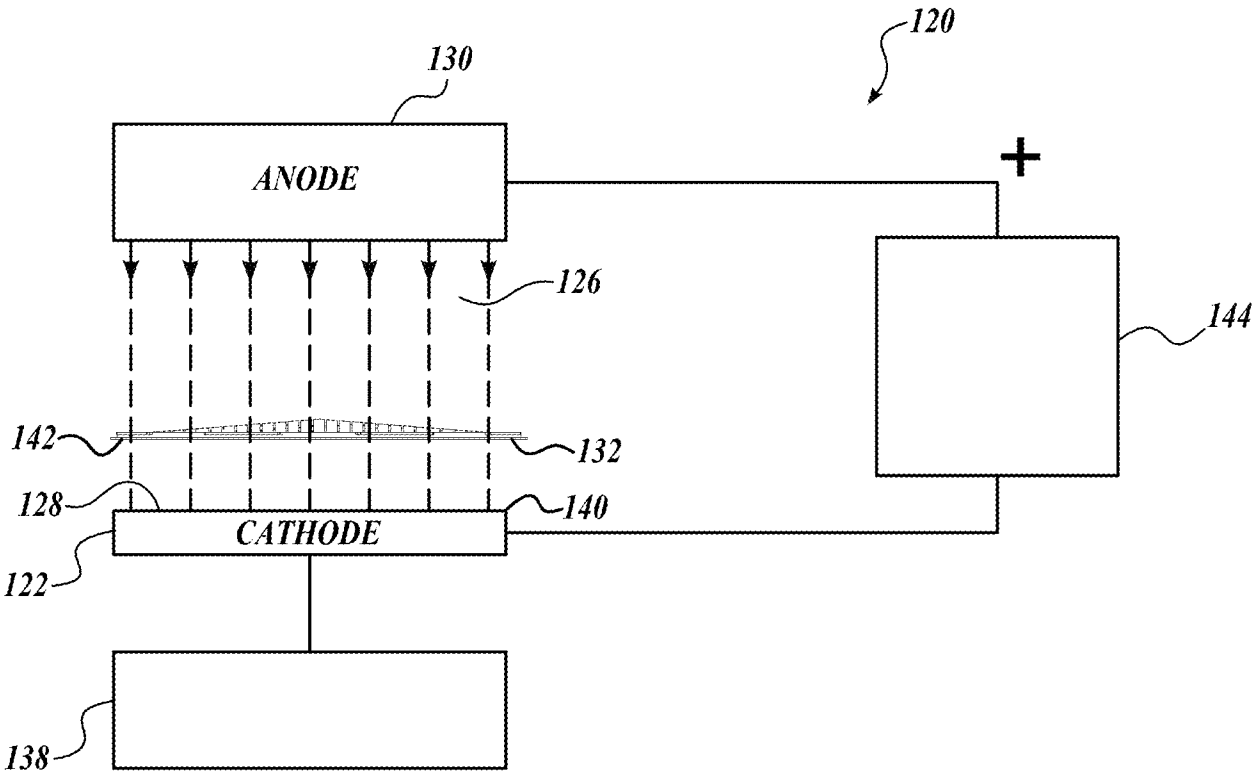
FIG. 9 is a perspective view of a shielding device in accordance with the embodiment of FIG. 8 next to an exemplary workpiece having a masked scribe area.
Figure 10:
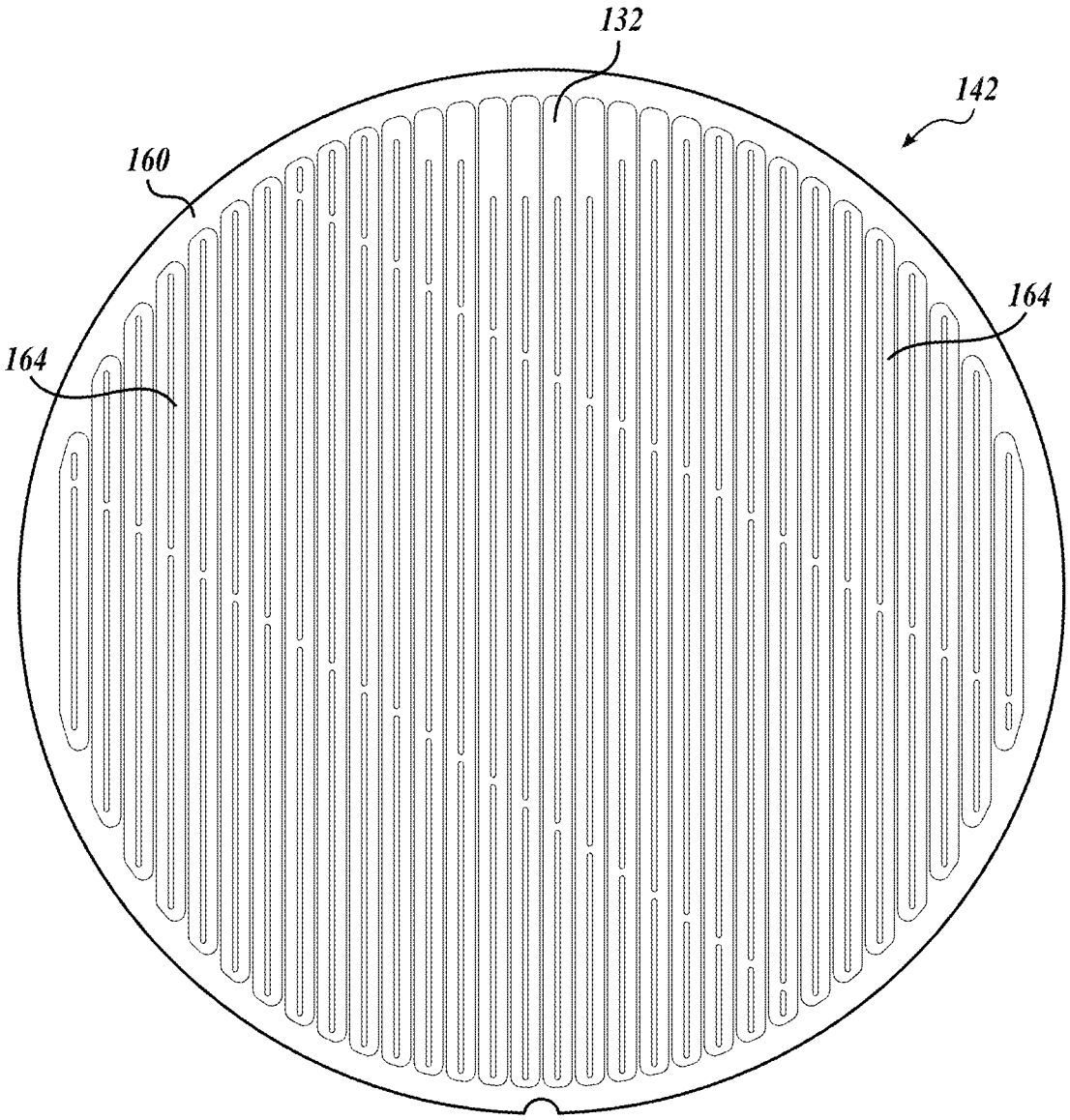
FIGS. 10 and 11 are respective top and bottom views of the shielding device of FIG. 8.
Figure 11:
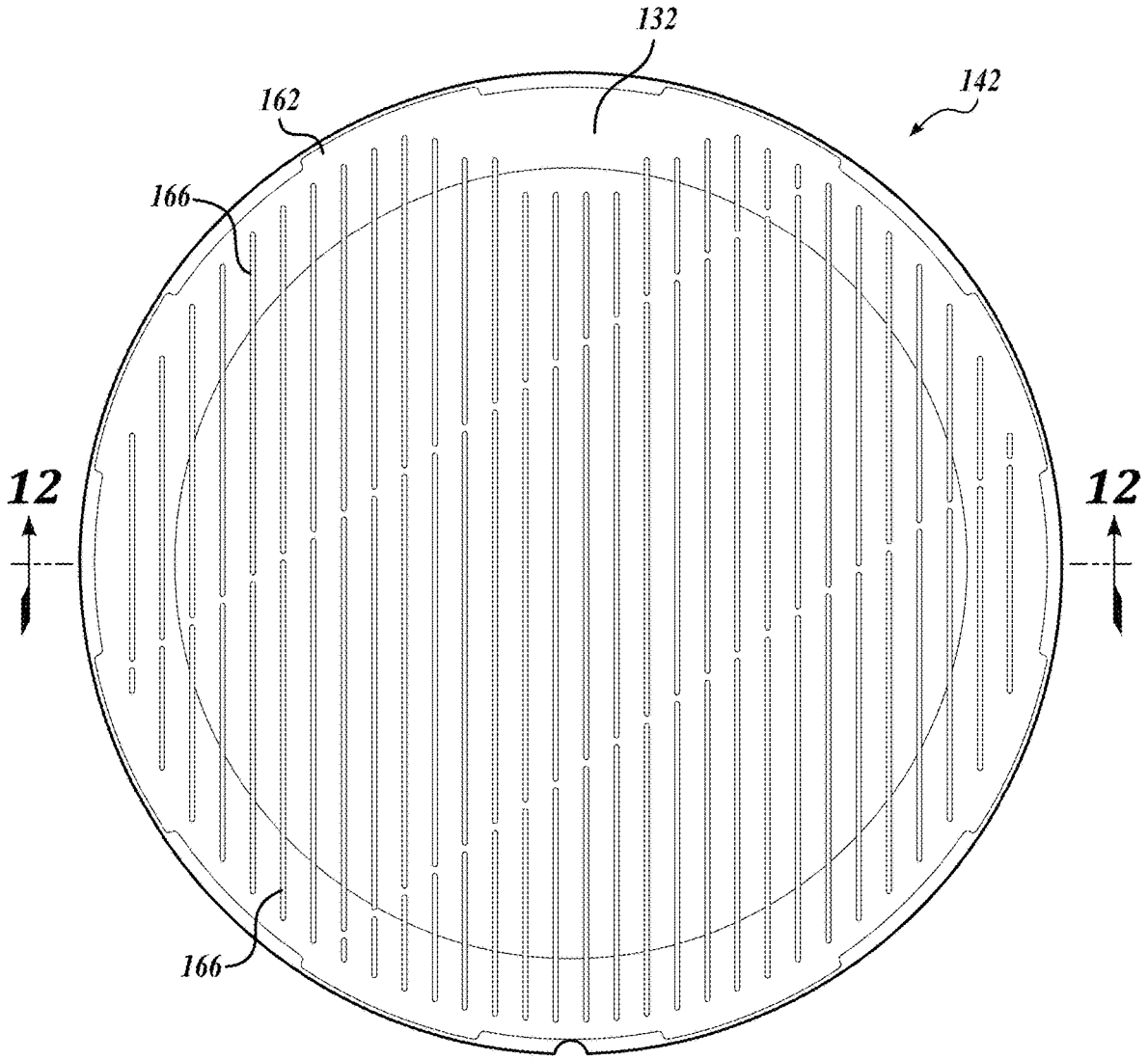
Figure 12:
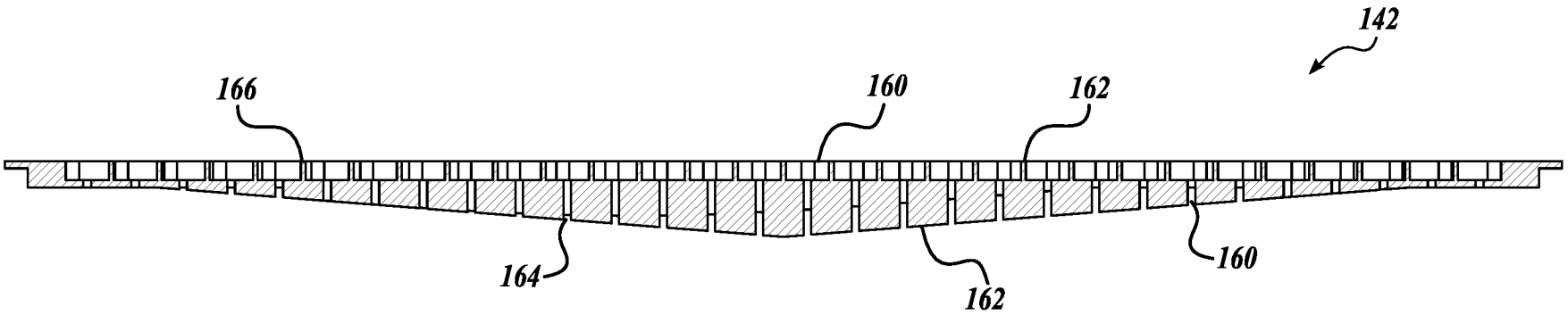
FIG. 12 is a cross-sectional view of the shielding device of FIG. 8 through the plane 12-12 of FIG. 11.
Figure 13:
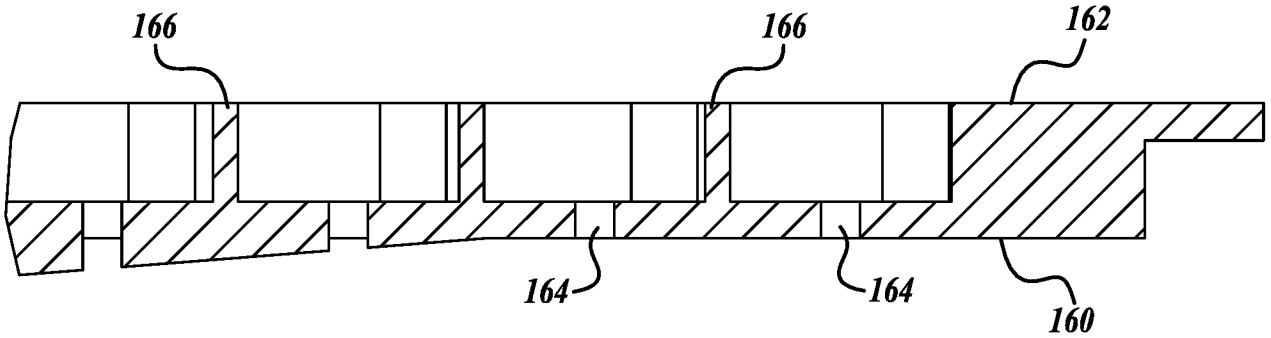
FIG. 13 is a close-up view of a portion of the cross-sectional view of the shielding device of FIG. 12.

In the illustrated embodiment of FIGS. 8-13, the shielding device 132 is incorporated with the paddle 142 to move with the paddle 142 in the electroplating cell 120 instead of being stationary. As seen in FIG. 9, the paddle 142 is typically used to improve mass transport and uniformity of mass transport by moving in a reciprocating linear fashion in the electrolyte 126, located in close proximity to the surface of the workpiece 122. Certain chamber designs are such that the distance between the paddle and the workpiece is only a few millimeters, leaving little room to insert a separate shielding feature. Therefore, the shielding device 132 may be coupled to or integrated with the paddle 142.

If the shielding device 132 is incorporated into the paddle 142, the paddle 142 may be configured to incorporate two steps: mixing the electrolyte 126 and periodically oscillating the shielding device 132 over the scribe region 136 of the workpiece 122. In the alternative, the paddle 142 may be configured to consistently mix the electrolyte 126, and the workpiece 122 may be configured to periodically oscillate over the shielding device 132.

Referring to FIG. 8, the shielding device 132 is a shielding section of a paddle 142 configured to align with the scribe region 136 of the workpiece 122. As seen in FIG. 9, the paddle 142 including a shielding section 132 is positioned between the cathode 128 and the anode 130 in the electroplating cell 120.

Referring to FIGS. 10-13, the paddle 142 has a first side 160 and a second side 162. The first side 160 includes a plurality of elongate channels 164 for receiving electrolyte 126 to be delivered to the cathode 128. In the illustrated embodiment, the channels 164 change in depth across the workpiece 122 for mass transfer purposes.

The second side 162 of the paddle 142 includes a plurality of mixing fins 166 to enhance agitation and maintain a substantially constant bulk concentration of ions in the electrolyte 126 across the workpiece 122 and throughout the electroplating cell 120. The paddle 142 mixes by reciprocating CW and CCW back and forth in a mixing pattern.

The shielding section 132 of the paddle 142 includes a region having no channels 164 and no mixing fins 166 to shield the scribe region 136 of the workpiece 122. The shielding section 132 may also be configured to have no channels 164, but may include mixing fins 166.

The shielding section 132 of the paddle 142, like the shield 32 of FIGS. 1 and 2, is designed to extend from the edge of the electroplating cell 120 or the workpiece 122, inward for a specific distance and along an arc or chord of the workpiece 122 to substantially cover the scribe region 136 of the workpiece 122 during at least a portion of the processing time.

In one embodiment of the present disclosure, the workpiece 122 is configured to oscillate to impart relative oscillation between the shielding section 132 and the scribe region 136 of the workpiece 122 to enhance the shielding in this localized anomaly area. At other times, the workpiece 122 is rotated completely over top of the paddle 142 and the shielding section 132 to limit the localized effect of shielding.

EXAMPLES

EXAMPLE 1 describes an exemplary workpiece rotation scheme and shielding device oscillation scheme used for plating in EXAMPLES 2-4. In EXAMPLES 2-4 below comparative data is provided for bump height variation in workpieces having no scribe region (EXAMPLE 2), a scribe region with no shielding (EXAMPLE 3), and a scribe region with shielding in accordance with embodiments of the present disclosure (EXAMPLE 4). EXAMPLE 5 provides comparative plating results for samples having shielding and no shielding of a masked scribe region. EXAMPLE 6 provides comparative plating results with open area variation.

Example 1

Exemplary Shielding Device Oscillation Pattern

An electrochemical deposition process included rotating the workpiece clockwise (CW) at 3 rpm for 47 seconds, then counter clockwise (CCW) at 3 RPM for 47 seconds for a predetermined amount of time depending on the plating thickness to be achieved. A shielding oscillation pattern included 1 rpm for 4 seconds both CW and CCW.

As a non-limiting example, if total plating time is 8 minutes or 480 seconds and the program is to oscillate over the scribe region for 50% of the plating time, the recipe might include, for example, two ECD steps. The first step (ECD 1) would be 240 seconds or 4 minutes in length. Oscillation occurs during this step, with the "scribe" region located over the shielding feature and the workpiece rotating at 1 RPM. Direction is reversed every 4 seconds. Therefore, total travel is approximately 24 degrees in one direction before reversing, with total travel being approximately 62 mm. The second step (ECD 2) will be 240 seconds or 4 minutes using 3 RPM for 47 seconds before reversing. Therefore, the workpiece travels more than one complete revolution before reversal rather than oscillating a localized portion of the workpiece over the shielding feature. The oscillation time depends on size of the scribe and can range from approximately 10% to approximately 75% of total plating time.

Example 2

Bump Height Data for No Scribe Region

Figure 3A:
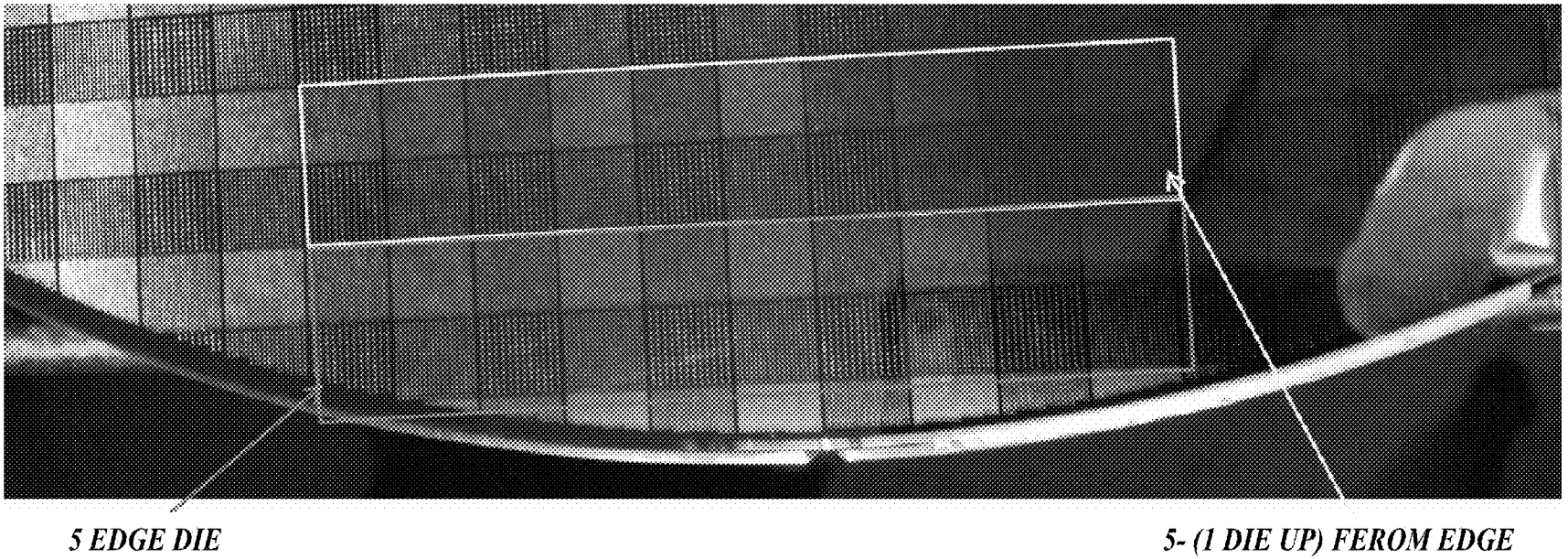
FIGS. 3A and 3B show an exemplary workpiece and data for bump height variation in a workpiece having no scribe region.
Figure 3B:
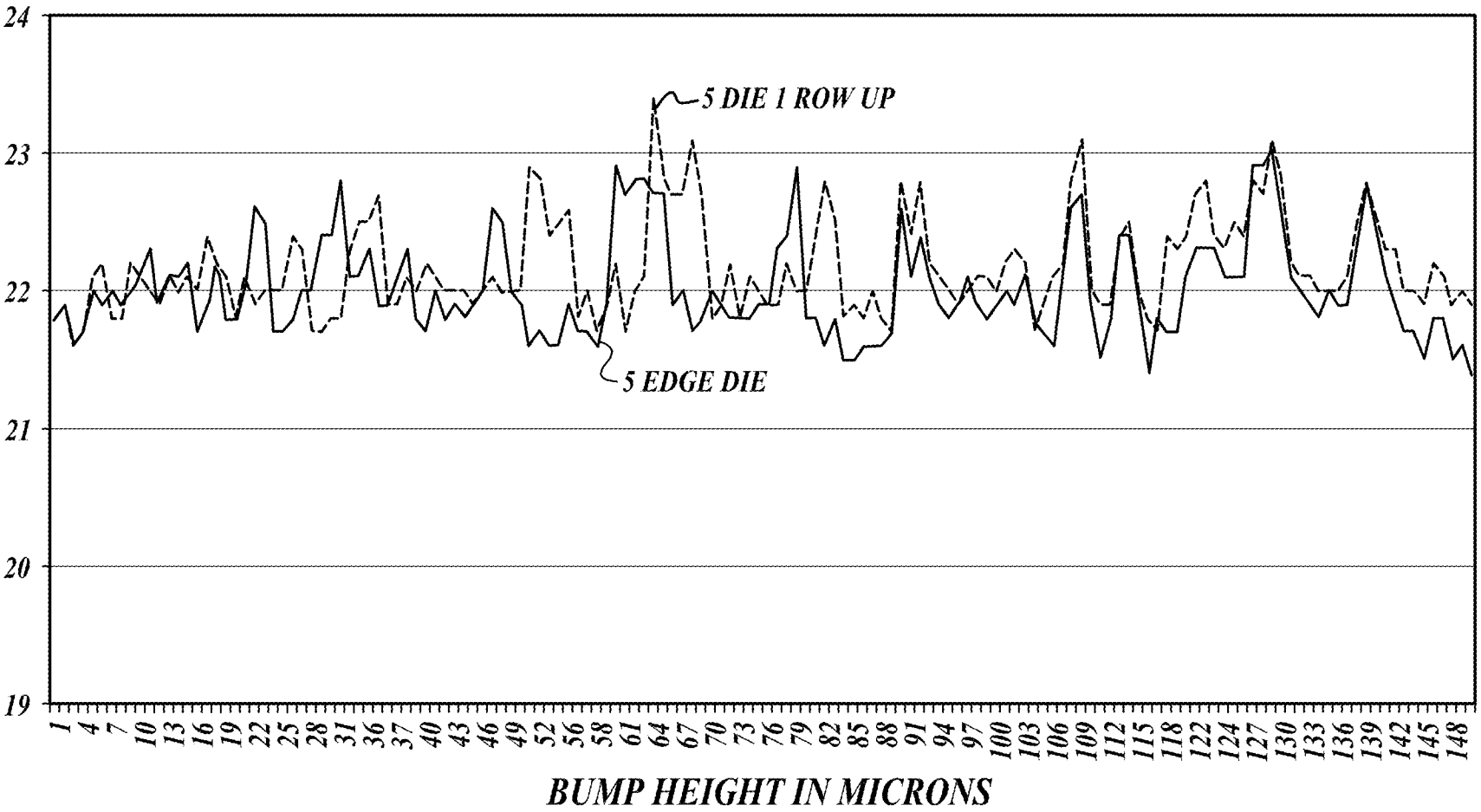

Referring to FIG. 3A, a portion of a workpiece having no scribe region is shown. Referring to FIG. 3B, bump height data is provided in microns for 5 edge die samples and 5 die samples one row from the edge. Although there is bump height variation for the 5 edge die samples and the 5 die samples one row from the edge, the data shows fairly consistent bump heights across both samples in a range between about 21.6 and about 23.4 microns, with the greatest variation between the peaks and valleys being about 1.8 microns.

Example 3

Bump Height Data for No Shielding of Scribe Region

Figure 4A:
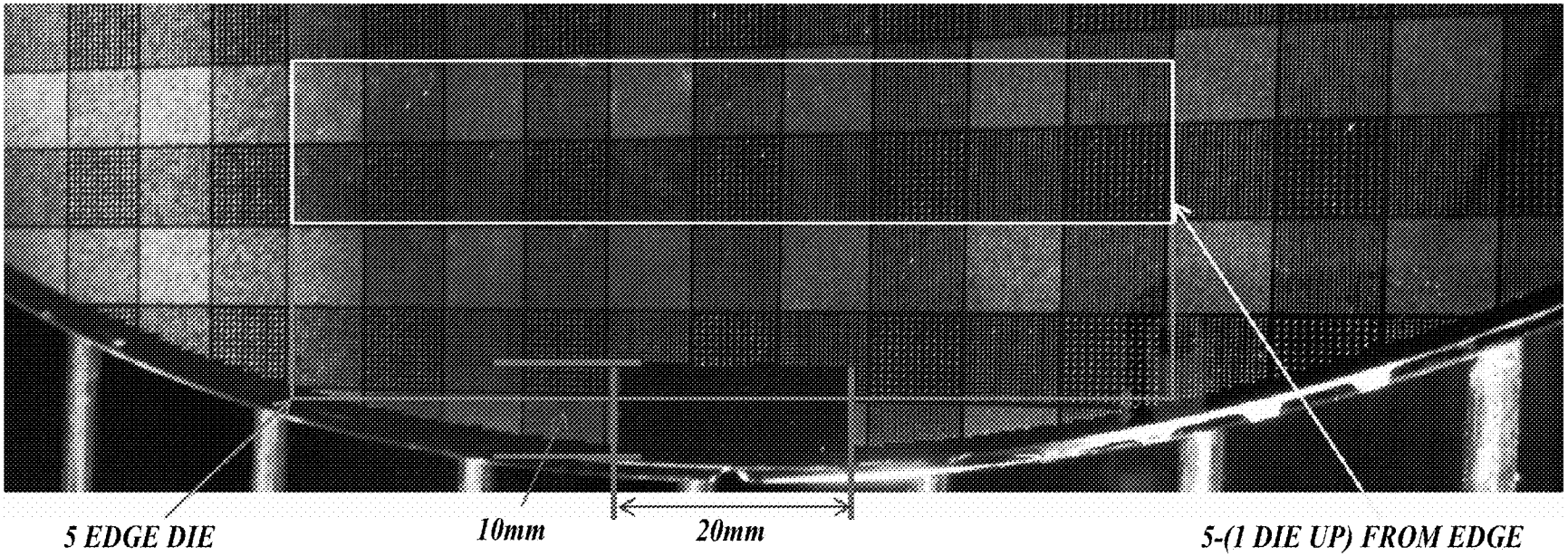
FIGS. 4A and 4B show an exemplary workpiece and data for bump height variation in a workpiece having a scribe region with no shielding.

Referring to FIG. 4A, a portion of a workpiece having a scribe region is shown. The scribe region is along the perimeter edge of the workpiece. The scribe region approximates a rectangular shape and is sized at about 20 microns in length and about 10 microns in width.

Figure 4B:
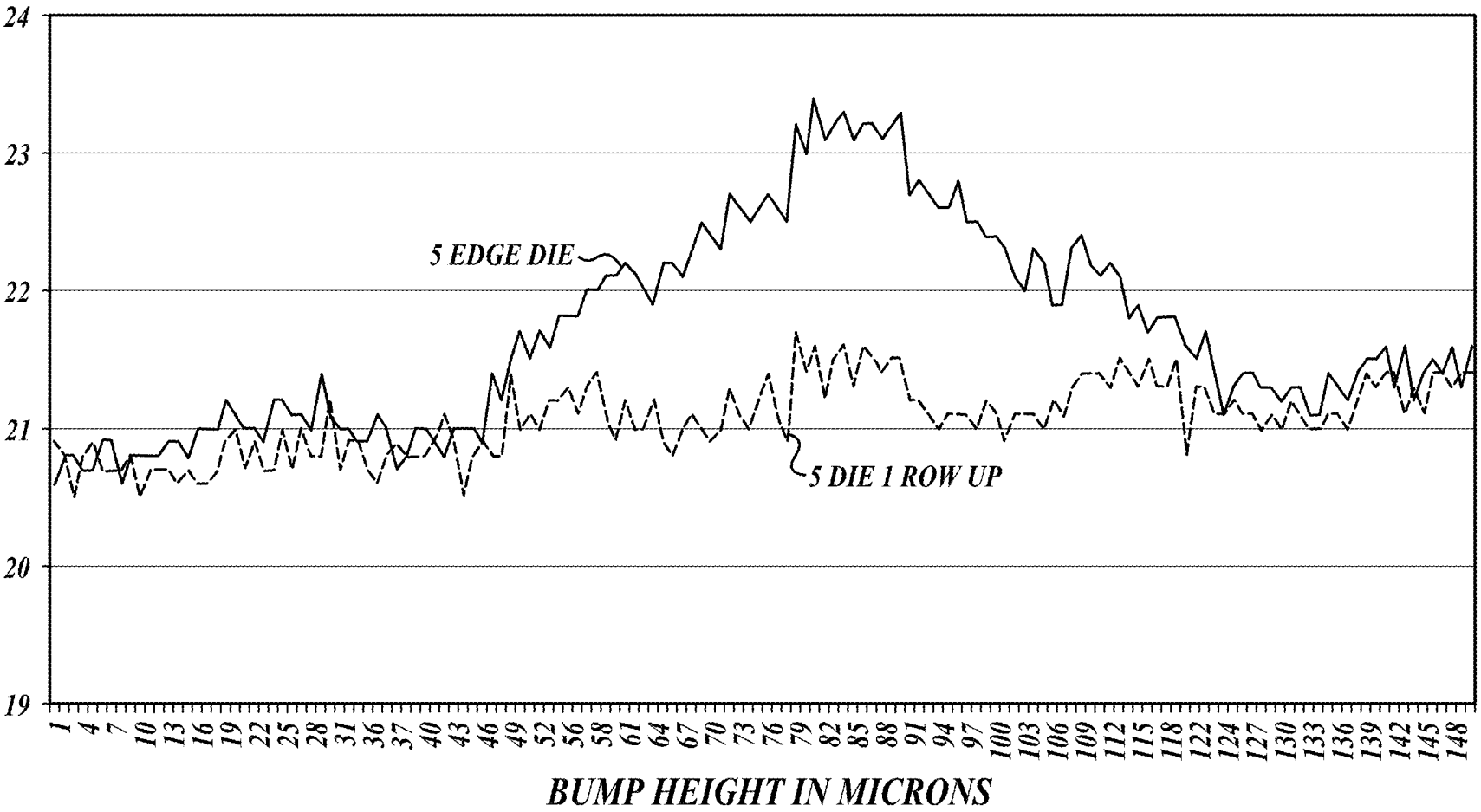

Referring to FIG. 4B, bump height data is provided in microns for 5 die samples above the notch and 5 die samples one row up from the notch. As can be seen in FIG. 4B, there was significant variation in bump height for the 5 die samples above the notch with bump heights in a range between about 20.7 and 23.3 microns, with the greatest variation between the peaks and valleys being about 2.6 microns. A significant increase was shown particularly in the die samples in the middle of the sample section, closest to the scribe region. The bump height tended to increase near the feature as a result of current crowding in the absence of a pattern to absorb power.

For the 5 die samples one row up from the notch, the data was more consistent than the data for the 5 die samples above the notch, with bump heights in a range between about 20.6 and 21.7 microns, with the greatest variation between the peaks and valleys being about 1.1 microns.

Example 4

Bump Height Data for Shielding of Scribe Region

Figure 5A:
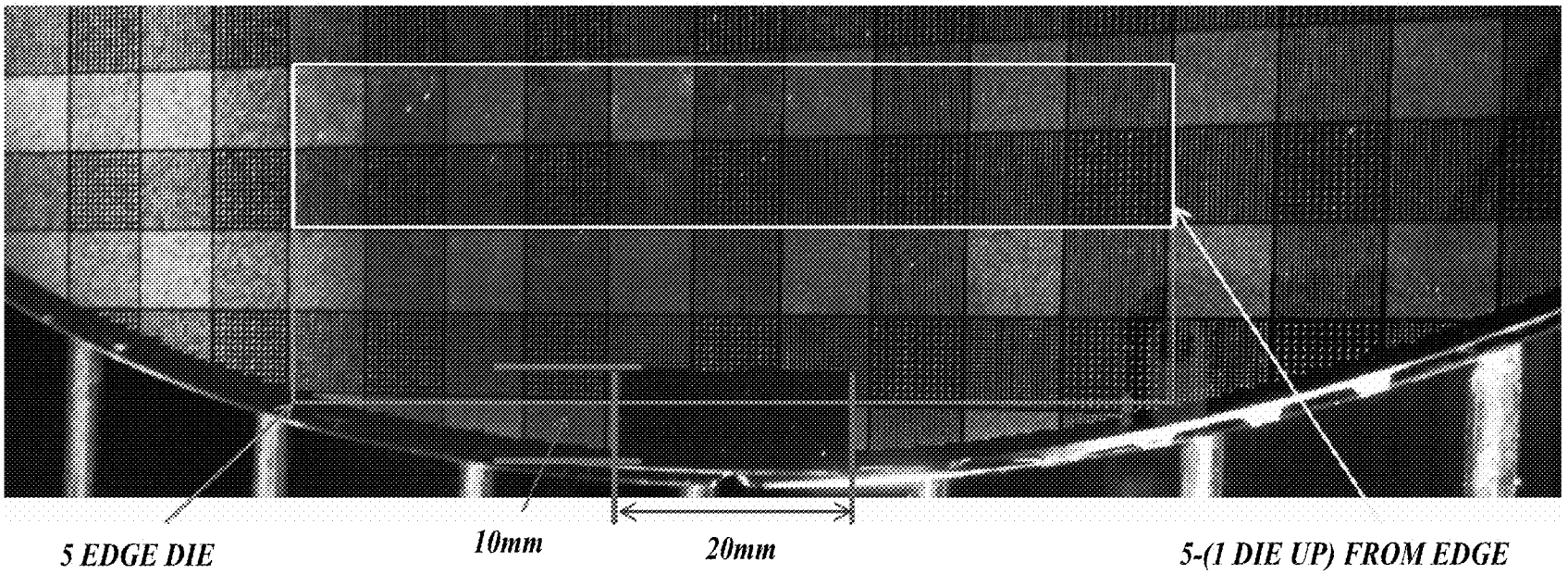
FIGS. 5A and 5B show an exemplary workpiece and data for bump height variation in a workpiece having a scribe region with shielding in accordance with one embodiment of the present disclosure.

Referring to FIG. 5A, a portion of a workpiece having a scribe region is shown. In this example, a shielding device was used in accordance with the embodiment shown and described with reference to FIGS. 1 and 2. The scribe region in FIG. 5B was similar to the scribe regions in FIG. 4B, along the perimeter edge of the workpiece. The scribe region approximated a rectangular shape and is sized at about 20 microns in length and about 10 microns in width.

Figure 5B:
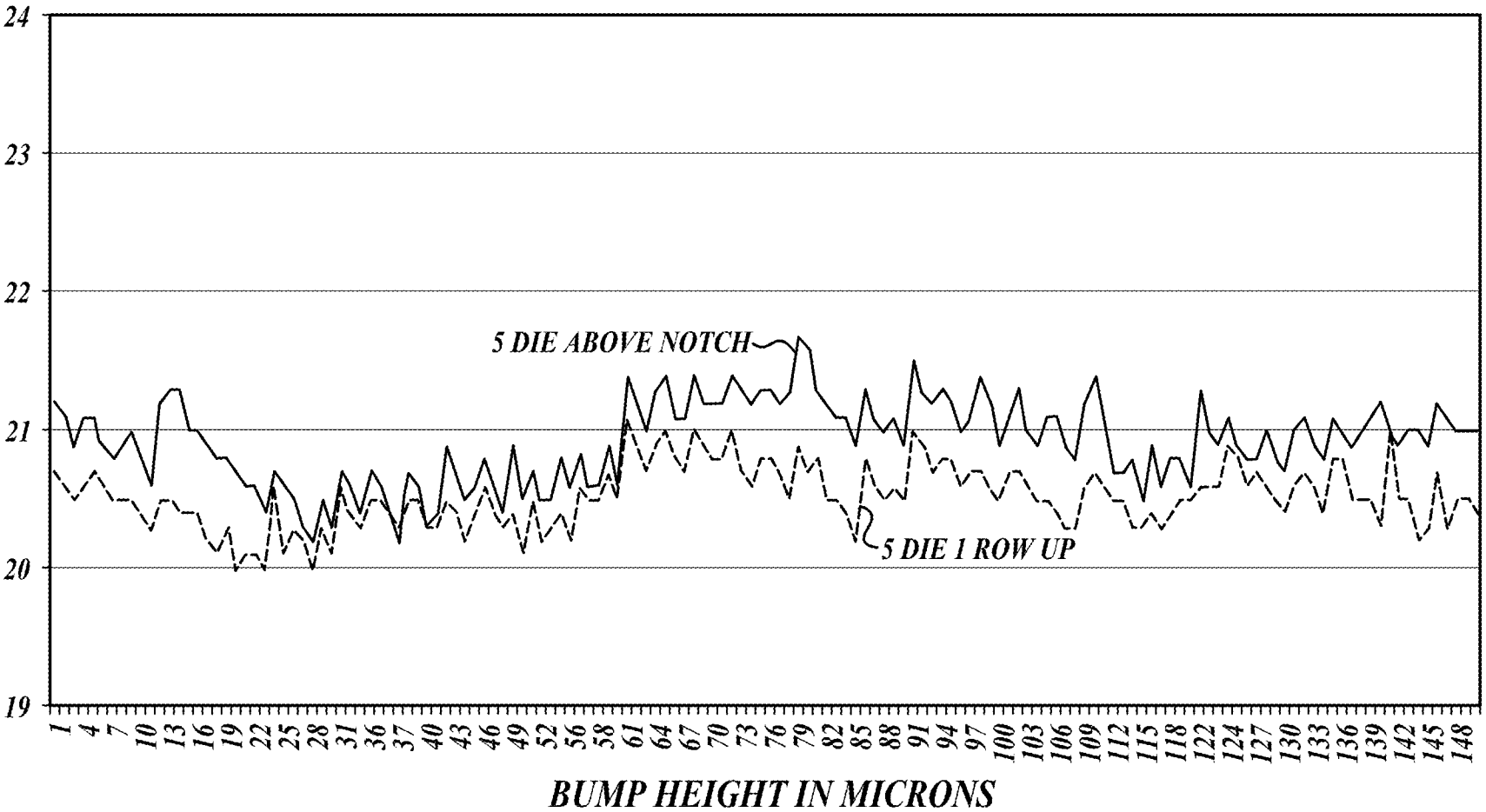

Referring to FIG. 5B, bump height data was provided in microns for 5 die samples above the notch and 5 die samples one row up from the notch. As can be seen in FIG. 5B, there was some variation in bump height for the 5 die samples above the notch with bump heights in a range between about 20.3 and 21.7 microns, with the greatest variation between the peaks and valleys being about 1.4 microns. An increase was shown particularly in the die samples in the middle of the sample section, closest to the scribe region.

For the 5 die samples one row up from the notch, the data was more consistent than the data for the 5 die samples above the notch, with bump heights in a range between about 20.0 and 21.2 microns, with the greatest variation between the peaks and valleys being about 1.2 microns.

The bump height data in FIG. 5B (shielding the scribe area) shows decreased bump variation compared to the data in FIG. 4B (no shielding of the scribe area). The data in FIG. 5B approximates bump height variation in the control sample of FIG. 3B having no scribe and no shielding.

Example 5

Comparative Plating Results

Figure 6A:
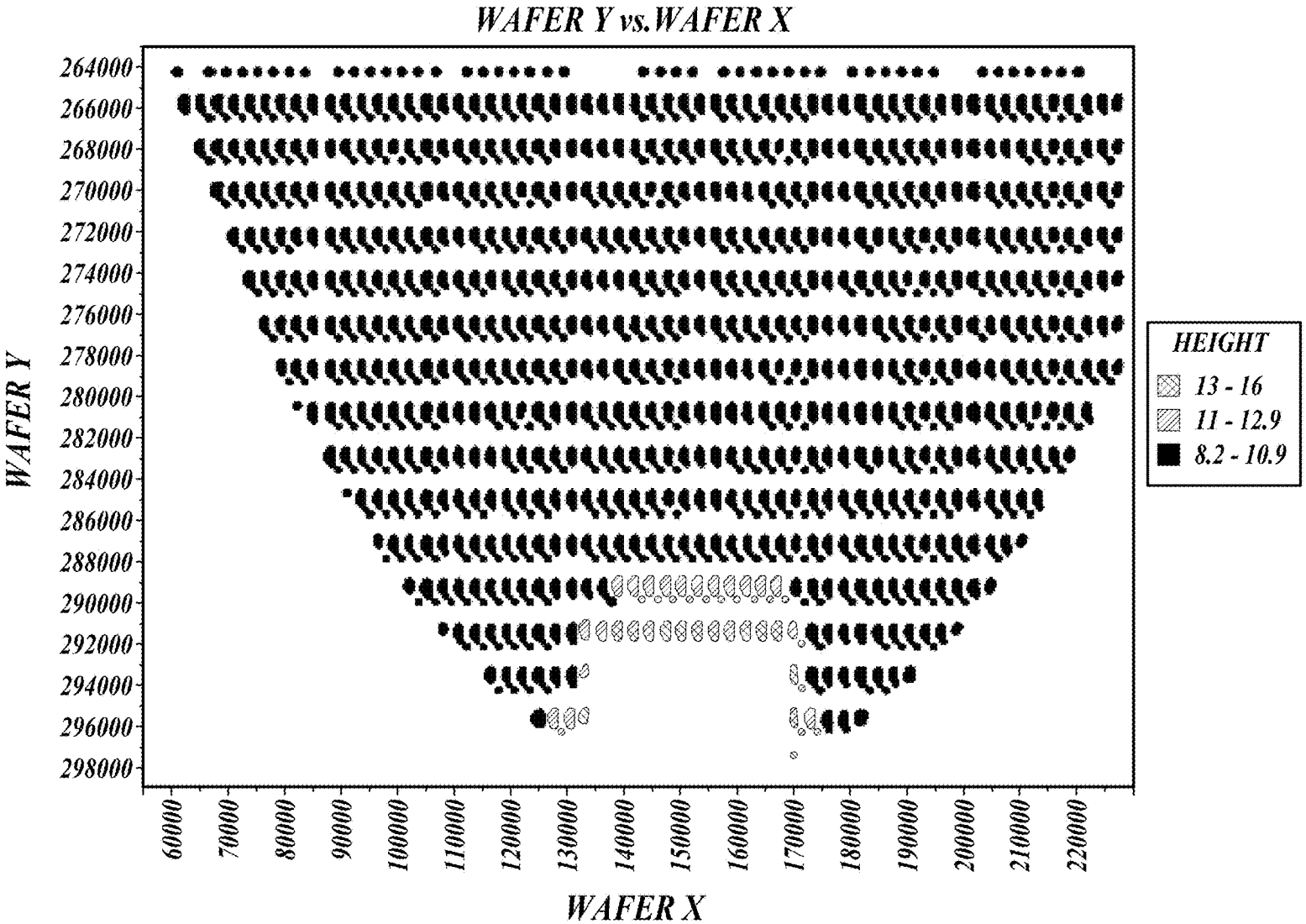
FIGS. 6A and 6B show plating results for comparative bump height for an electroplating cell without a shielding device and an electroplating cell with a shielding device.
Figure 6B:
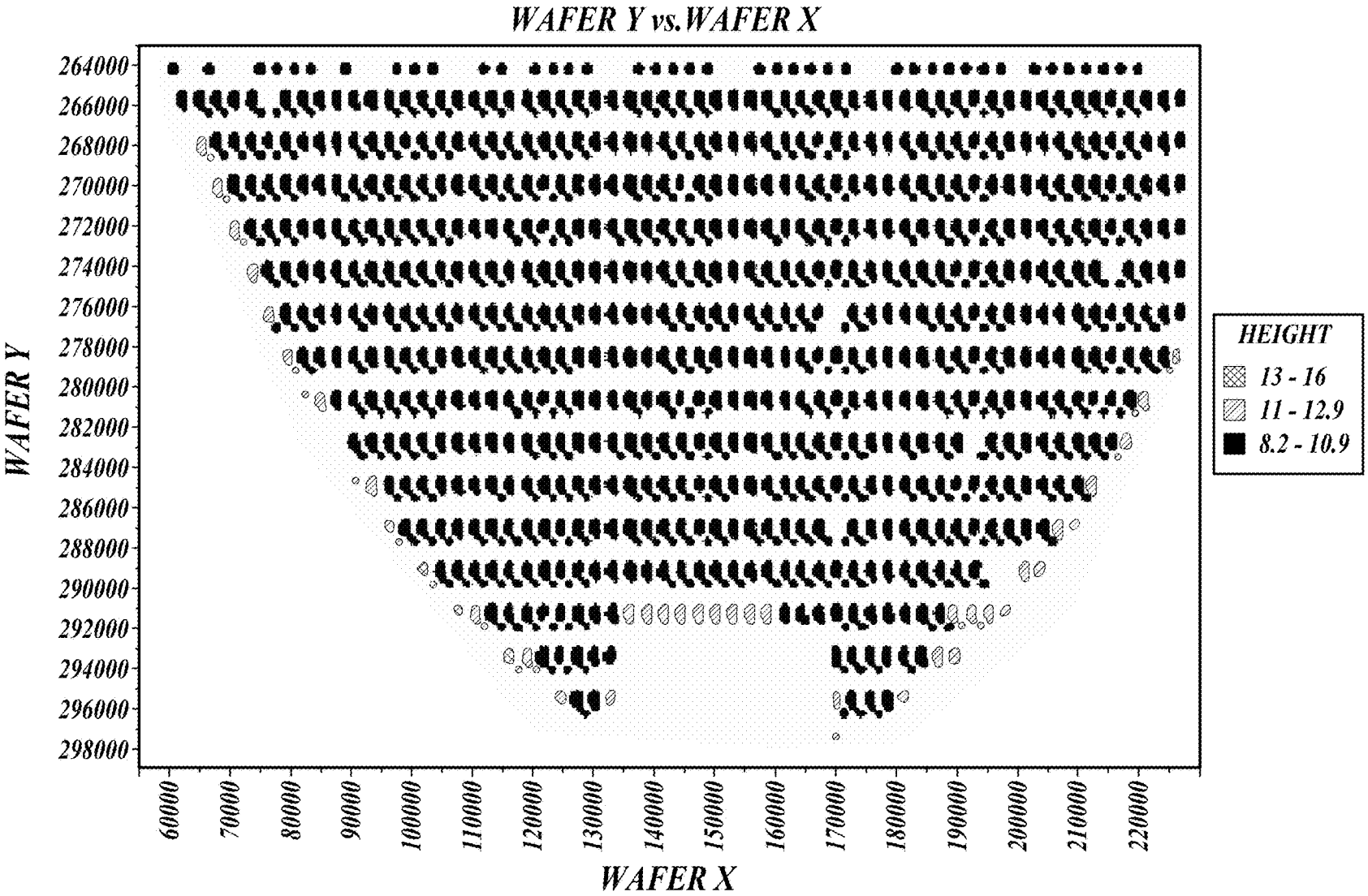

Referring to FIGS. 6A and 6B, reduction in non-uniform deposition near the scribe region is shown for processes using a shielding device in accordance with the embodiment of FIGS. 1 and 2 in a process described in EXAMPLE 1.

FIG. 6A shows plating results (compressed on the x-axis) for baseline hardware, with an average bump height variation of 8.2 microns. Most of the bump height variation is seen on the perimeter of the masked scribe region.

FIG. 6B shows plating results (compressed on the x-axis) for hardware in accordance with one embodiment of the present disclosure, with an average bump height variation of 2.2 microns. Most of the bump height variation is seen on the outer edge of the workpiece.

Example 6

Comparative Plating Results with Open Area Variations

Figure 7:
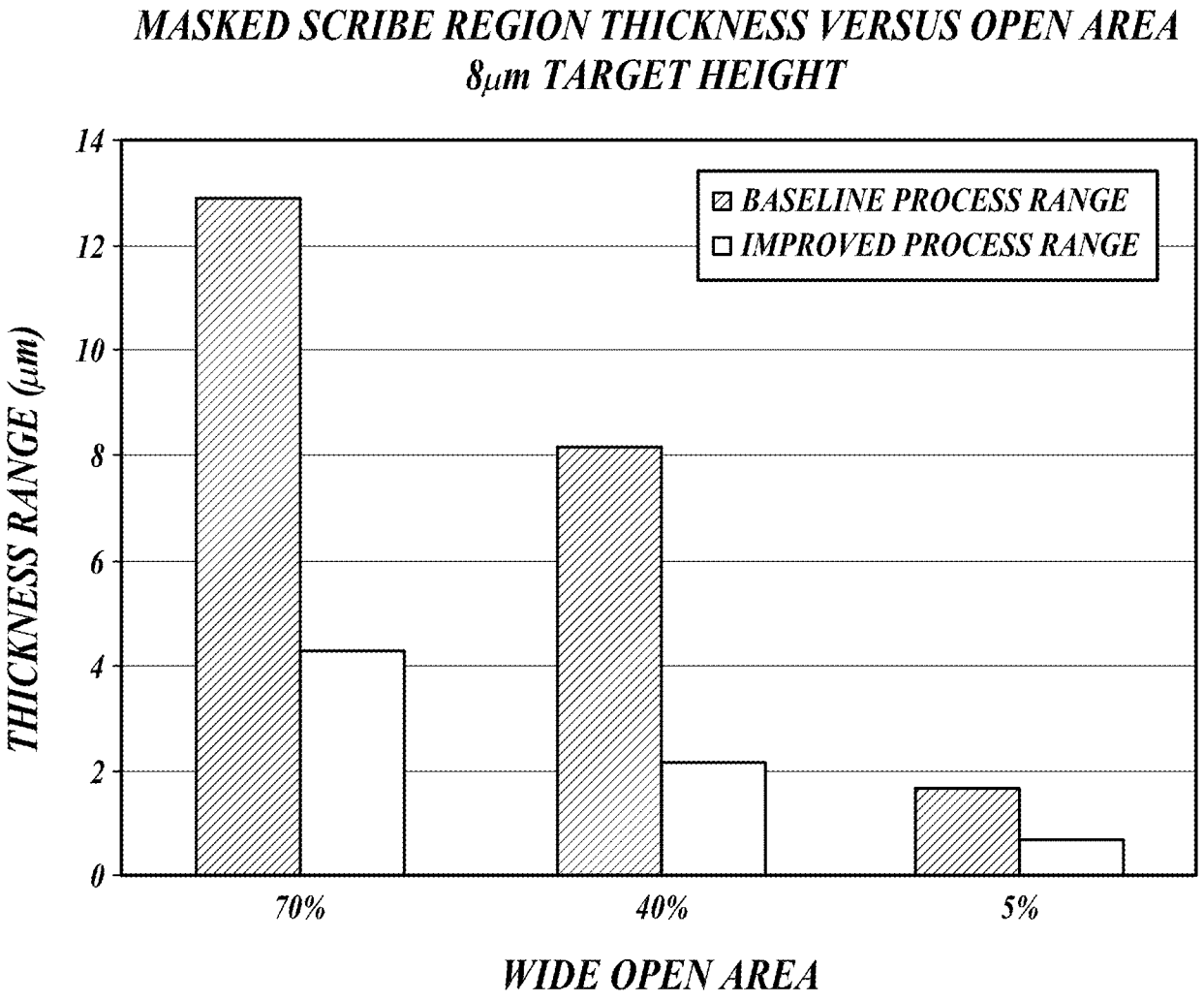
FIG. 7 shows plating results as a function of total amount of open area on a workpiece.

Referring to FIG. 7, results from three different plating experiments show that as the non-uniformity in plating increases near the masked scribe region is a function of open area on the workpiece. Compare 70% workpiece open area, 40% workpiece open area, and 5% workpiece open area.

With a shielding process in accordance with the embodiment of FIGS. 1 and 2, each of the three samples shows a similar percentage reduction in non-uniformity of plating in the workpiece of about 50% to about 75%.

While illustrative embodiments have been illustrated and described, it will be appreciated that various changes can be made therein without departing from the spirit and scope of the disclosure.

The embodiments of the disclosure in which an exclusive property or privilege is claimed are defined as follows:

1. An electroplating system for depositing a metal onto a surface of a substrate, comprising:

(a) an electroplating chamber configured to receive an electrolyte containing metal ions;

(b) the substrate configured to serve as a cathode of the electroplating system, wherein a surface of the substrate:

is disposed in contact with the electrolyte; and includes an anomaly region at or near the outer perimeter of the surface of the substrate;

(c) an anode disposed in the electroplating chamber;

(d) a shielding device disposed between the cathode and the anode, the shielding device corresponding to the shape of the cathode and configured to shield the anomaly region of the substrate, wherein the shielding device is free from attachment to the anode;

(e) a bidirectional oscillator drivingly connected to the shielding device, the oscillator imparting a bidirectional oscillation motion to the shielding device relative to the substrate by imparting bidirectional alternating rotational movement to the shielding device over a partial revolution of the shielding device in a first rotational direction and then in the opposite rotational direction; and (f) wherein the shielding device comprises a first side with a plurality of elongated spaced apart side by side channels extending in the direction along the radial axis of the shielding device for receiving and circulating the electrolyte to be delivered to the cathode, the plurality of elongated spaced apart side by side channels disposed over the entire surface of the first side of the shielding device, except for a shielding section of the shielding device corresponding to the anomaly region of the substrate, the shielding section extending inwardly from the outer perimeter of the shielding device.

2. The electroplating system of claim 1, wherein the shielding section extends inwardly from the outer perimeter of the shielding device in the range of about 5 mm to about 25 mm of the radial distance of the shielding device.

3. The electroplating system of claim 1, wherein the shielding section has an angular length in the range of about 2 degrees to about 35 degrees.

4. The electroplating system of claim 1, wherein the shielding section of the shielding device is shaped and sized to substantially align with the shape of the anomaly region.

5. The electroplating system of claim 1, further comprising an agitating device for agitating the electrolyte.

6. The electroplating system of claim 5, wherein the shielding device is located between the agitating device and the substrate, between the agitating device and the anode, or is integrated into the agitating device.

7. The electroplating system of claim 5, wherein the shielding device moves with the agitating device.

8. The electroplating system of claim 7, wherein the oscillator is configured to oscillate the agitating device.

9. The electroplating system according to claim 1, wherein the depth of the plurality of elongated spaced apart side by side channels vary about the area of the shield.

10. The electroplating system according to claim 1, wherein the shield further comprises a second side comprising a plurality of side by side, spaced apart mixing fins extending longitudinally across the area of the second side of the shield and projecting outwardly from the shield in a direction along the rotational axis of the shield for agitation of the electrolyte.

11. The electroplating system of claim 5, wherein the agitating device comprises a mixing paddle to agitate the electrolyte.

12. The electroplating system according to claim 10, wherein the mixing fins extend across the diameter of the second side of the shield, except in the area of the shielding section of the shield.

13. A device for shielding a surface of a substrate in an electroplating chamber for electroplating a metal on to the surface of the substrate, the electroplating chamber configured to receive an electrolyte containing metal ions, an anode, and a substrate having a surface disposed to contact the electrolyte, wherein the surface of the substrate is configured to serve as a cathode, and wherein the surface of the substrate includes an anomaly region at or near the outer perimeter of the surface of the substrate, the device comprising:

a shield disposed within the electroplating chamber and having an outer perimeter configured for alignment with the outer perimeter of the substrate, the shield comprising an extension section extending inwardly from the outer perimeter a radial distance and extending along the outer perimeter of the shield a distance corresponding to the size and location of the anomaly region, wherein the shield is free from attachment to the anode;

an actuator drivingly connected to the shield, the actuator controlled to impart bidirectional oscillating rotational motion to the shield relative to the substrate about a rotational axis, the shield driven in repeated bidirectional oscillating motion by the actuator in a first direction through a partial revolution of the shield and then driven in the opposite direction through a partial revolution of the shield, the shield also driven in repeated bidirectional oscillating motion by the actuator in a first direction through at least a full revolution of the shield and then driven in the opposite direction through at least a full revolution of the shield; and wherein the shield comprises a first side with a plurality of elongated spaced apart side by side channels extending in the direction along the radial axis of the shield for receiving and circulating the electrolyte to be delivered to the cathode, the elongated channels disposed over the entire surface of the first side of the shield, except for the extension section of the shield.

14. The device according to claim 13, wherein the extension section extends radially inwardly of the outer perimeter of the shield a distance in the range of about 5 mm to about 25 mm.

15. The device according to claim 13, wherein the depth of the plurality of elongated spaced apart channels vary about the area of the shield.

16. The device according to claim 13, wherein the shield further comprises a second side comprising a plurality of side by side, spaced apart mixing fins extending longitudinally across the area of the second side of the shield and projecting outwardly from the shield in a direction along the rotational axis of the shield for agitation of the electrolyte.

17. The device according to claim 16, wherein the mixing fins extend substantially across the width of the shield.

18. The device according to claim 16, wherein the mixing fins extend across the diameter of the second side of the shield, except in the area of the extension section of the shield.

19. An electroplating system for depositing a metal onto a surface of a substrate, comprising:

(a) an electroplating chamber configured to receive an electrolyte containing metal ions;

(b) the substrate configured to serve as a cathode of the electroplating system, wherein a surface of the substrate:

is disposed in contact with the electrolyte; and includes an anomaly region at or near the outer perimeter of the surface of the substrate;

(c) an anode disposed in the electroplating chamber;

(d) a shielding device disposed between and spaced from both the cathode and the anode and shaped to shield the anomaly region of the substrate, wherein the shielding device is free from attachment to the anode;

(e) a bidirectional oscillator drivingly connected to the shielding device;

(f) a controller controlling the oscillator to impart a bidirectional oscillation motion to the shielding dev ice relative to the substrate by sequentially driving the shielding device:

over a partial revolution of the shielding device in a first rotational direction and then driving the shielding device over a partial revolution of the shielding device in the opposite rotational direction, and also over at least a full revolution of the shielding device in a first rotational direction and then driving the shielding device over at least a full revolution of the shielding device in the opposite rotational direction; and (g) wherein the shielding device comprises a first side with a plurality of elongated spaced apart side by side channels extending in the direction along the radial axis of the shielding device for receiving and circulating the electrolyte to be delivered to the cathode, the elongated spaced apart channels disposed over the entire surface of the first side of the shielding device, except for an area of the first side of the shielding device corresponding to the anomaly region of the substrate, the anomaly region extending inwardly from the outer perimeter of the shielding device.

* * * * *